US010905171B2

(12) United States Patent
Dooley

(10) Patent No.: US 10,905,171 B2
(45) Date of Patent: Feb. 2, 2021

(54) ANCHOR BOOT

(71) Applicant: Terry Dooley, West Des Moines, IA (US)

(72) Inventor: Terry Dooley, West Des Moines, IA (US)

( * ) Notice: Subject to any disclaimer, the term of this patent is extended or adjusted under 35 U.S.C. 154(b) by 51 days.

(21) Appl. No.: 16/277,738

(22) Filed: Feb. 15, 2019

(65) Prior Publication Data

US 2020/0260801 A1 Aug. 20, 2020

(51) Int. Cl.
*A41B 11/02* (2006.01)
*A41B 11/12* (2006.01)

(52) U.S. Cl.
CPC ..... *A41B 11/02* (2013.01); *A41B 11/123* (2013.01); *A41B 2300/32* (2013.01); *A41B 2400/44* (2013.01)

(58) Field of Classification Search
CPC ..... A41B 11/00; A41B 11/123; A41B 11/12; A41B 11/005; A41B 11/02; A41B 11/125; A41B 11/003; A41B 11/008; A41B 11/04; A41B 11/126; A41B 11/128; A41B 2400/44; A41B 2300/32; A41B 2500/50; A43B 5/0405; A43B 19/00; A43B 23/07; A43B 23/28
USPC ..... 36/10; 2/239
See application file for complete search history.

(56) References Cited

U.S. PATENT DOCUMENTS 3,003,154 A * 10/1961 Litman ..... A41B 11/02 2/239
4,008,350 A * 2/1977 Crawford ..... A41B 11/00 521/54
5,133,088 A * 7/1992 Dunlap ..... A41B 11/02 2/239
5,784,721 A * 7/1998 Huff ..... A41B 11/02 2/239
5,823,195 A * 10/1998 Shook ..... A61F 5/30 128/893
5,964,047 A * 10/1999 Covatch ..... A43B 7/34 36/10
2001/0007180 A1* 7/2001 Bordin ..... A43B 5/0405 36/93
2006/0206987 A1* 9/2006 Turner ..... A41B 11/125 2/239
2009/0113602 A1* 5/2009 Lambertz ..... A41B 11/02 2/239
2011/0119808 A1* 5/2011 Sherman ..... A61F 5/0127 2/239

(Continued)

FOREIGN PATENT DOCUMENTS

FR 2897756 A1 * 8/2007 ..... A41B 11/006

*Primary Examiner* — Amy Vanatta

(74) *Attorney, Agent, or Firm* — Fredriksen & Byron, P.A.

(57) ABSTRACT

An anchor boot including a cuff, a heel operatively attached to and positioned below the cuff, the heel including a heel flap and a heel turn, a gusset operatively attached to the heel flap, the heel turn, and the cuff, the gusset positioned below the cuff and in front of the heel, a foot operatively attached to the gusset and positioned in front of the gusset, and memory foam imbedded within sides of the gusset provides a more secure and tight fit around the ankles in any type of boot wear. The adjustable configuration allows for use of the anchor boot with any boot but is particularly useful with rubber boots and warm and cold weather wading boots.

20 Claims, 4 Drawing Sheets

(56) References Cited

U.S. PATENT DOCUMENTS

| | | | | |
|---|---|---|---|---|
| 2013/0145521 | A1* | 6/2013 | Spicuzza | A41B 11/007 2/239 |
| 2017/0164661 | A1* | 6/2017 | Hawkins | A41B 11/02 |

* cited by examiner

ANCHOR BOOT

FIELD OF THE INVENTION

The present invention relates generally to an anchor boot and corresponding method of use in at least the clothing and textile industries. More particularly, but not exclusively, the present invention relates to an anchor boot that provides a more secure and tight fit when used in combination with outdoor activity boot wear.

BACKGROUND OF THE INVENTION

The background description provided herein is for the purpose of generally presenting the context of the present disclosure. Work of the presently named inventors, to the extent the work is described in the present disclosure, as well as aspects of the description that may not otherwise qualify as prior art at the time of filing, are neither expressly nor impliedly admitted as prior art.

Outdoor activity boot wear comes in the standard, integer sizes of 8 to 14. Because a snug fit between the wearer's foot and the boot is required to keep the wearer's foot warm and dry, this prevents individuals from effectively using a pair of boots. This is particularly true if the wearer has a foot smaller than a size 8, the wearer has a foot that is a "half size" (e.g., 8½), a manufacturer's sizes fluctuate in comparison to other manufacturers' sizes, a manufacturer's design of the boot (e.g. using a wider width for the boot near the ankle or the toe) fluctuates in comparison to other manufacturers' design, and the boot is susceptible to significant movement while the wearer is walking through mud, sand, or snow.

Thus, there exists a need in the art for an anchor boot which provides a more secure and tight fit around the ankles to accommodate any type of boot wear.

SUMMARY OF THE INVENTION

Therefore, it is a primary object, feature, or advantage of the present invention to improve on or overcome the deficiencies in the art.

It is a further object, feature, or advantage of the present invention to provide an anchor boot that may be used in a wide variety of applications. For example, the anchor boot may include an adjustable configuration that is adapted for a rubber boot or a warm and cold weather wading boot.

It is still yet a further object, feature, or advantage of the present invention to provide an anchor boot that keeps a wearer's foot warm in cold weather and dry in humid or rainy weather.

It is still yet a further object, feature, or advantage of the present invention to provide an anchor boot that increases balance and stability when walking through mud, sand, and snow. Furthermore, the anchor boot disclosed herein It is still yet a further object, feature, or advantage of the present invention to provide an anchor boot safely secures a wearer's foot and does not exert any unnecessary pressure on specific areas of the wearer's foot, thereby preventing the user from getting blisters, bruises, or infections.

It is still yet a further object, feature, or advantage of the present invention to provide an anchor boot that is cost effective. Furthermore, the anchor boot disclosed herein allows for individuals who are between sizes the flexibility of buying and effectively using an off the shelf pair of shoes, boots, or waders.

It is still yet a further object, feature, or advantage of the present invention to provide an anchor boot that is reliable and durable and has a long usable life.

It is still yet a further object, feature, or advantage of the present invention to provide an anchor boot which is easily put on and removed from a wearer's foot.

It is still yet a further object, feature, or advantage of the present invention to provide an anchor boot that is easily manufactured, repaired, replaced, stored, transported, and cleaned.

It is still yet a further object, feature, or advantage of the present invention to provide an anchor boot that is aesthetically pleasing.

It is still yet a further object, feature, or advantage of the present invention to incorporate an anchor boot into a system accomplishing some or all of the previously stated objectives.

It is still yet a further object, feature, or advantage of the present invention to provide methods of wearing or manufacturing an anchor boot accomplishing some or all of the previously stated objectives.

The following provides a list of aspects or embodiments disclosed herein and does not limit the overall disclosure. It is contemplated that any of the embodiments disclosed herein can be combined with other embodiments, either in full or partially, as would be understood from reading the disclosure.

According to some aspects of the present disclosure, an anchor boot comprises a cuff, a heel operatively attached to and positioned below the cuff, said heel including a heel flap and a heel turn, a gusset operatively attached to the heel flap, the heel turn, and the cuff, said gusset positioned below the cuff and in front of the heel, a foot operatively attached to the gusset and positioned in front of the gusset, and memory foam imbedded within sides of the gusset.

According to some other aspects of the present disclosure, a system for keeping a foot of a wearer warm and dry comprises the anchor boot and other footwear, such as a rubber boot or a wading boot.

According to some additional aspects of the present disclosure, the anchor boot may further comprise a leg extending downward from the cuff and connecting the cuff to the heel. The leg may be molded, stitched, or glued to the cuff. The anchor boot may include an open toe located an end of the foot or a closed toe attached to an end of the foot. The cuff may comprise memory foam. An elastic strap may be attached to the cuff and may include a hook and loop fastener. The anchor boot may be lined with synthetic fiber thermal insulation.

According to some other aspects of the present disclosure, a method for keeping a foot of a wearer warm and dry comprises wearing the anchor boot on the foot of a wearer and wearing other footwear over the anchor boot. A snug fit is created by allowing every point of each internal surface of the other footwear to contact an external surface of the anchor boot. The anchor boot may be secured to a leg of the wearer with an elastic strap attached to the cuff, and the elastic strap may employ the use of a hook and loop fastener.

According to some additional aspects of the present disclosure, the method may also include preventing moisture from contacting the foot of the wearer with memory foam in the cuff of the anchor boot and preventing heat loss in the foot of the wearer with synthetic fiber thermal insulation lined in the anchor boot.

These or other objects, features, and advantages of the present invention will be apparent to those skilled in the art after reviewing the following detailed description of the illustrated embodiments, accompanied by the attached drawings.

Figure 1:
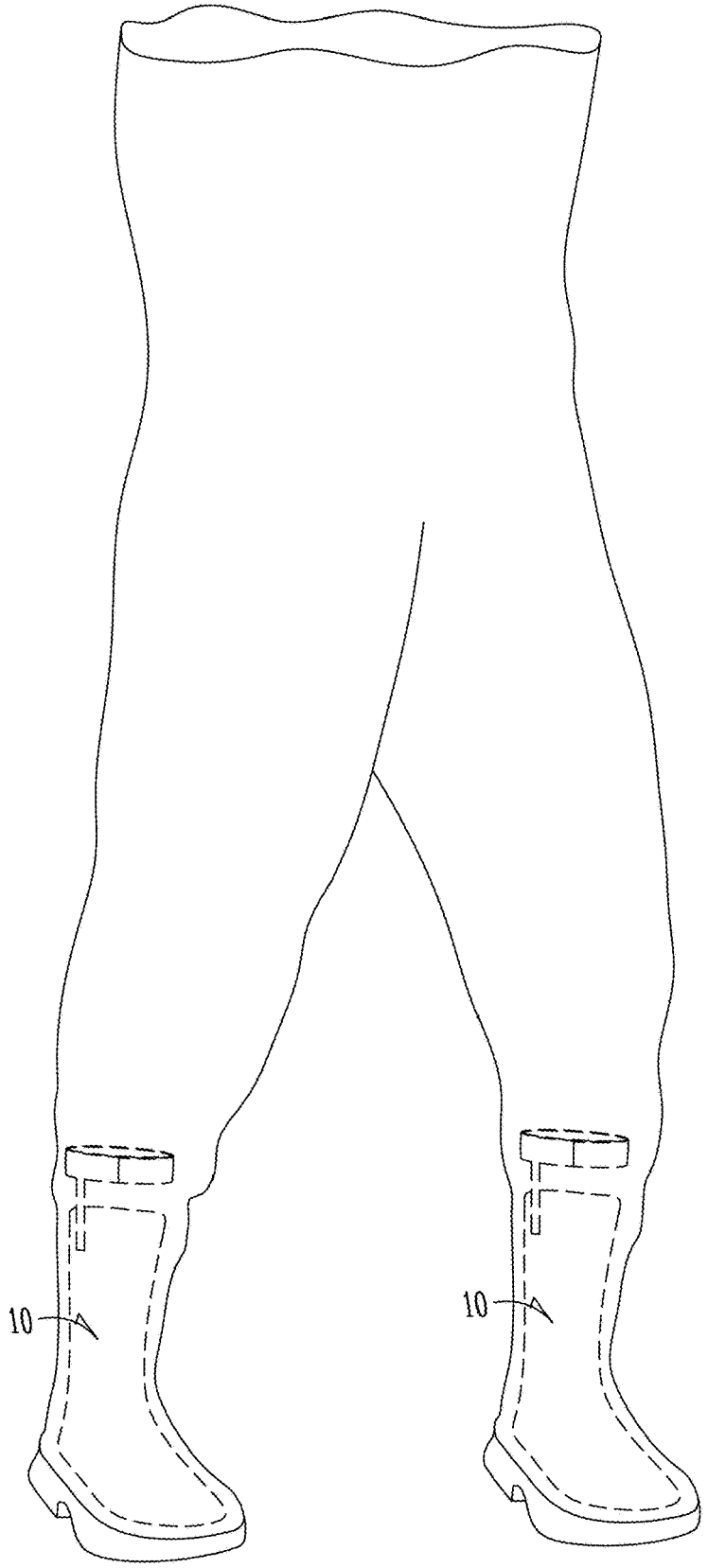
FIG. 1 is an illustration of a pair of anchor boots used in combination with hip waders and a pair of boots, according to some aspects of the present disclosure.

Various embodiments of the present disclosure illustrate several ways in which the present invention may be practiced. These embodiments will be described in detail with reference to the drawings, wherein like reference numerals represent like parts throughout the several views. Reference to specific embodiments does not limit the scope of the present disclosure and the drawings represented herein are presented for exemplary purposes.

DETAILED DESCRIPTION OF THE INVENTION

The following definitions and introductory matters are provided to facilitate an understanding of the present invention. Unless defined otherwise, all technical and scientific terms used herein have the same meaning as commonly understood by one of ordinary skill in the art to which embodiments of the present invention pertain.

The terms "a," "an," and "the" include plural referents unless context clearly indicates otherwise. Similarly, the word "or" is intended to include "and" unless context clearly indicate otherwise. The word "or" means any one member of a particular list and also includes any combination of members of that list.

The terms "invention" or "present invention" as used herein are not intended to refer to any single embodiment of the particular invention but encompass all possible embodiments as described in the specification and the claims.

Terms such as first, second, vertical, horizontal, top, bottom, upper, lower, front, rear, end, sides, concave, convex, and the like, are referenced according to the views presented. These terms are used only for purposes of description and are not limiting unless these terms are expressly included in the claims. Orientation of an object or a combination of objects may change without departing from the scope of the invention.

The apparatuses, systems, and methods of the present invention may comprise, consist essentially of, or consist of the components of the present invention described herein. The term "consisting essentially of" means that the apparatuses, systems, and methods may include additional components or steps, but only if the additional components or steps do not materially alter the basic and novel characteristics of the claimed apparatuses, systems, and methods.

The following embodiments are described in sufficient detail to enable those skilled in the art to practice the invention however other embodiments may be utilized. Mechanical, procedural, and other changes may be made without departing from the spirit and scope of the invention. Accordingly, the scope of the invention is defined only by the appended claims, along with the full scope of equivalents to which such claims are entitled.

Figure 2:
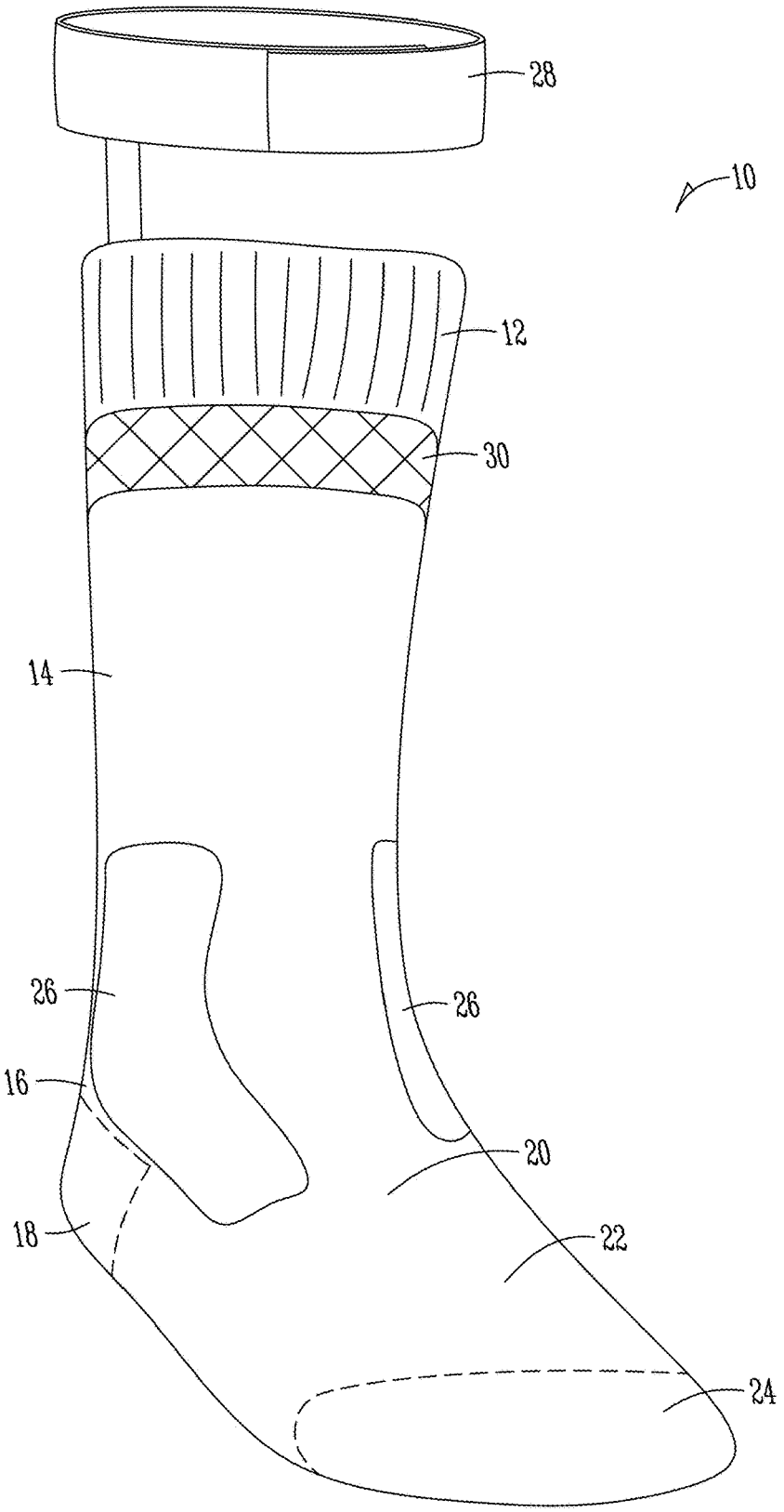
FIG. 2 shows a front perspective view of an anchor boot, according to some aspects of the present disclosure.
Figure 3:
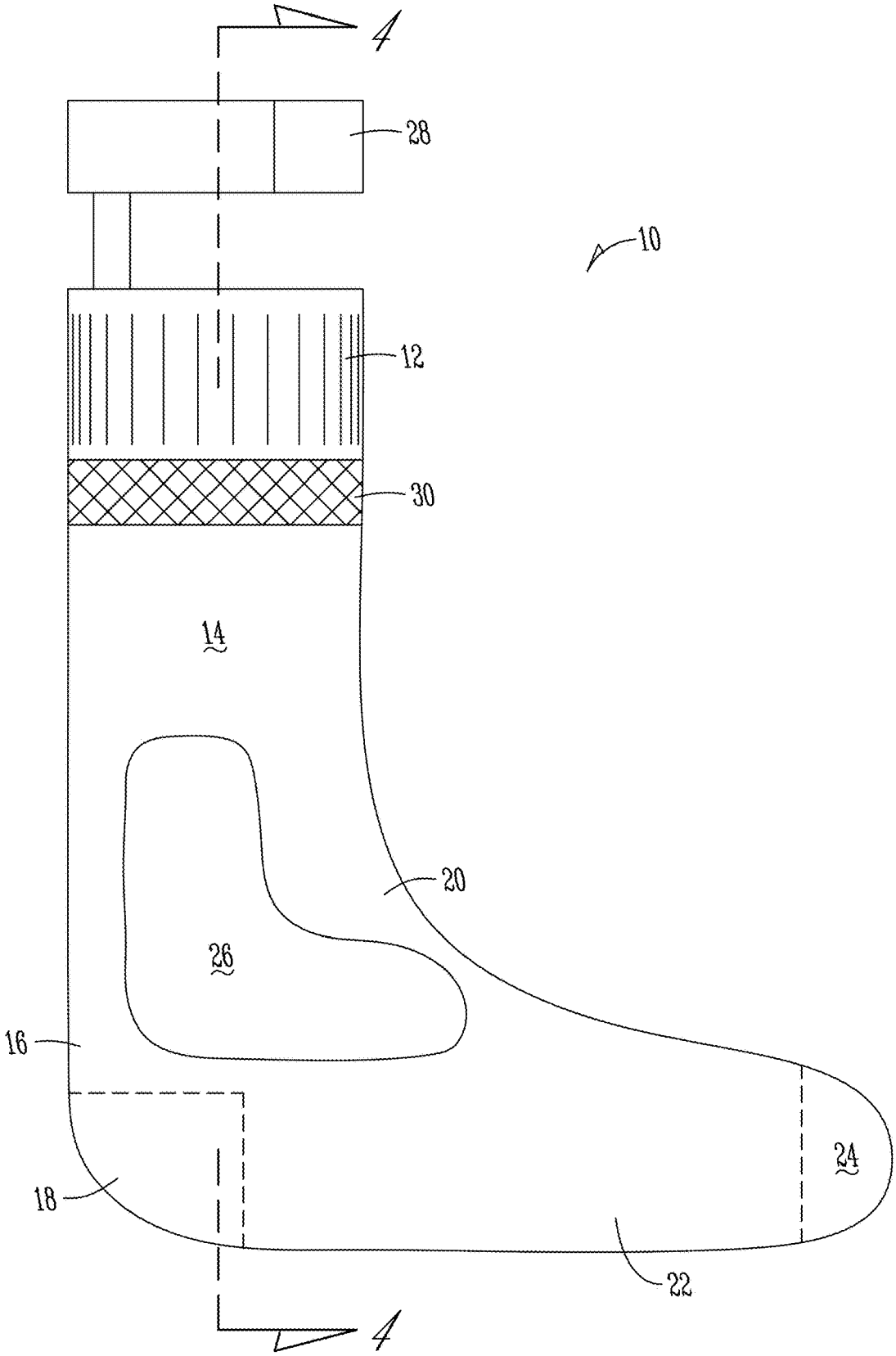
FIG. 3 shows a side elevation view of the anchor boot, according to some aspects of the present disclosure.
Figure 4:
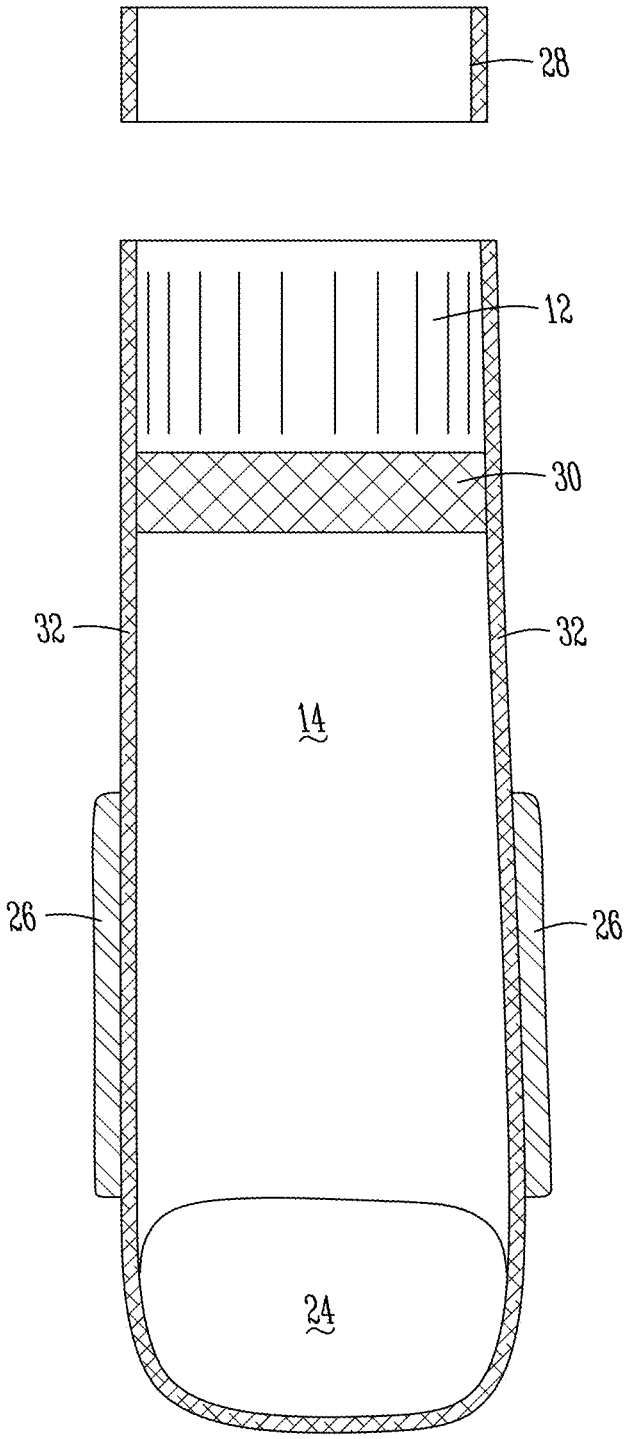
FIG. 4 shows a plan view looking at the anchor boot from a rear perspective, according to some aspects of the present disclosure.

Referring now to the figures, an anchor boot 10 or stocking is shown. The anchor boot 10 depicted in the figure includes a cuff 12 and a leg 14 extending downward from the cuff and connecting the cuff to the heel. The heel includes a heel flap 16 and a heel turn 18. The heel is attached to and positioned below the leg 14. Thus, the heel can also be said to be operatively attached to and positioned below the cuff 12. In some embodiments (not shown) where the anchor boot is also an ankle boot, the cuff 12 is attached directly to the heel flap 16 and there is no leg 14 in the anchor boot 10. A gusset 20 is operatively attached to the heel flap 16, the heel turn 18, and the cuff 12. The gusset 20 is positioned below the cuff 12 and in front of the heel. A foot 22 of the anchor boot 10 is operatively attached to the gusset 20 and positioned in front of the gusset 20. In some embodiments (such as the embodiment shown in FIGS. 2 and 3), a toe 24 is attached at a forward end of the foot 22 and allows the foot of a wearer to be completely enclosed within the anchor boot 10 while the anchor boot 10 is worn.

The anchor boot may be made from any number of textiles or other known materials, including neoprene, breathable fabric, and wool. The anchor boot 10 may be lined with synthetic fiber thermal insulation 32, such as that which is sold under the tradename Thinsulate, to prevent heat loss in the foot of the wearer in cold environments.

Memory foam 26 or another pressurized material that can compress and expand as desired is imbedded within sides of the gusset 20 such that the memory foam 26 is preferably located just over the ankle of the wearer. In some embodiments, the memory foam 26 is also imbedded within sides of the heel flap 16, leg 14, cuff 12, and foot 22. Memory foam 26 in the cuff 12 helps prevent moisture from contacting the foot of the wearer with memory foam in the cuff of the anchor boot. The memory foam 26 or other pressurized material can be attached to the cuff 12 via stitching, glue, or a mold 30 to form an upper portion of the stocking.

Securing the anchor boot 10 to a leg of the wearer may be accomplished with an elastic strap 28 attached to the cuff. The elastic strap may include a hook and loop fastener, such as that which is sold under the tradename Velcro.

The anchor boot 10 is intended to be worn between a foot of a wearer and other footwear, such as a rubber boot or a wading boot, to keep the foot of the warm and dry. The anchor boot 10 helps create a snug fit by allowing every point of each internal surface of the other footwear to contact an external surface of the anchor boot 10. Thus, if a wearer has feet that are between sizes, the wearer now has the flexibility of buying and effectively using an off the shelf pair of shoes, boots, or waders.

From the foregoing, it can be seen that the present invention accomplishes at least all of the stated objectives.

LIST OF REFERENCE NUMERALS

The following list of reference numerals is provided to facilitate an understanding and examination of the present disclosure and is not exhaustive. Provided it is possible to do so, elements identified by a numeral may be replaced or used in combination with any elements identified by a separate numeral. Additionally, numerals are not limited to the descriptors provided herein and include equivalent structures and other objects possessing the same function.

10 anchor boot
12 cuff
14 leg

16 heel flap
18 heel turn
20 gusset
22 foot
24 toe
26 memory foam
28 elastic strap
30 stitching, glue, or mold
32 synthetic fiber thermal insulation The present disclosure is not to be limited to the particular embodiments described herein. The following claims set forth a number of the embodiments of the present disclosure with greater particularity.

What is claimed is:

1. An anchor boot comprising a stocking, the stocking comprising:

a cuff;

a heel operatively attached to and positioned below the cuff, said heel including a heel flap and a heel turn;

a gusset operatively attached to the heel flap, the heel turn, and the cuff, said gusset positioned below the cuff and in front of the heel;

a foot operatively attached to the gusset and positioned in front of the gusset; and memory foam, wherein a first distinct piece of memory foam is imbedded within a first side of the gusset, and wherein a second distinct piece of memory foam is imbedded within the cuff, the first distinct piece of memory foam being different than the second distinct piece of memory foam.

2. The anchor boot of claim 1 further comprising a leg extending downward from the cuff and connecting the cuff to the heel.

3. The anchor boot of claim 2 wherein the leg is molded, stitched, or glued to the cuff.

4. The anchor boot of claim 1 further comprising an open toe located at one end of the foot.

5. The anchor boot of claim 1 further comprising a closed toe attached to an end of the foot.

6. The anchor boot of claim 1 wherein the second distinct piece of memory foam is imbedded within the cuff by stitching, gluing, or molding the second distinct piece of memory foam into the cuff.

7. The anchor boot of claim 1 further comprising an elastic strap attached to the cuff.

8. The anchor boot of claim 7 wherein the elastic strap includes a hook and loop fastener.

9. The anchor boot of claim 1 wherein the anchor boot is lined with synthetic fiber thermal insulation.

10. A system for keeping a foot of a wearer warm and dry, the system comprising:

the anchor boot of claim 1; and separate footwear worn outside of the anchor boot.

11. The system of claim 10 wherein the separate footwear comprises a rubber boot or a wading boot.

12. The system of claim 10 further comprising an elastic strap attached to the cuff.

13. The system of claim 12 further comprising wherein the elastic strap includes a hook and loop fastener.

14. The system of claim 10 wherein the anchor boot is lined with synthetic fiber thermal insulation.

15. A method for keeping a foot of a wearer warm and dry, the method comprising:

wearing the anchor boot of claim 1 on the foot of a wearer; and wearing separate footwear over the anchor boot.

16. The method of claim 15 further comprising creating a snug fit by allowing every point of each internal surface of the separate footwear to contact an external surface of the anchor boot.

17. The method of claim 15 further comprising securing the anchor boot to a leg of the wearer with an elastic strap attached to the cuff.

18. The method of claim 17 wherein securing the anchor boot to the leg of the wearer with the elastic strap is accomplished at least in part through use of a hook and loop fastener.

19. The method of claim 15 further comprising preventing moisture from contacting the foot of the wearer with the second distinct piece of memory foam in the cuff of the anchor boot.

20. The method of claim 15 further comprising preventing heat loss in the foot of the wearer with synthetic fiber thermal insulation lined in the anchor boot.

* * * * *